US006349982B2

(12) United States Patent
Fayngersh et al.

(10) Patent No.: US 6,349,982 B2
(45) Date of Patent: Feb. 26, 2002

(54) REVERSIBLE MORTISE LOCK

(75) Inventors: Zakhary Fayngersh, West Hartford; Damon J. Lenk, Bristol, both of CT (US)

(73) Assignee: Corbin Russwin, Inc., Berlin, CT (US)

( * ) Notice: Subject to any disclaimer, the term of this patent is extended or adjusted under 35 U.S.C. 154(b) by 0 days.

(21) Appl. No.: 09/346,840

(22) Filed: Jul. 2, 1999

(51) Int. Cl.[7] ..... E05C 1/12
(52) U.S. Cl. ..... 292/165; 292/245
(58) Field of Search ..... 292/165, 169.14, 292/169.15, 169.22, 244, 245; 70/462

(56) References Cited

U.S. PATENT DOCUMENTS

| | | | | |
|---|---|---|---|---|
| 168,986 | A | | 10/1875 | Griscom |
| 197,531 | A | | 11/1877 | Vetter |
| 286,580 | A | | 10/1883 | Billings |
| 302,657 | A | | 7/1884 | Heizmann et al. |
| 950,108 | A | * | 2/1910 | Lawrence |
| 1,057,663 | A | | 4/1913 | Page |
| 1,126,181 | A | | 1/1915 | Cleaver |
| 1,469,829 | A | | 10/1923 | Teich |
| 1,627,420 | A | | 5/1927 | Thomas |
| 2,516,991 | A | | 8/1950 | Heyer ..... 292/244 |

(List continued on next page.)

FOREIGN PATENT DOCUMENTS

| | | | |
|---|---|---|---|
| DE | 1938639 | 2/1971 | ..... E05B/45/01 |
| DE | 2031370 | 12/1971 | ..... E05B/63/04 |
| DE | 2136636 | 2/1973 | ..... E05B/63/04 |
| DE | 1938639 | 5/1978 | ..... E05B/63/04 |
| DE | 2160563 | 9/1979 | ..... E05B/63/04 |
| DE | 2827939 | 1/1980 | ..... E05B/63/04 |
| NO | 63812 | * 8/1941 | ..... 68/62 |
| WO | 9425709 | 11/1994 | ..... E05B/15/02 |

*Primary Examiner*—Gary Estremsky
(74) *Attorney, Agent, or Firm*—Moore & Van Allen PLLC; Michael G. Johnston

(57) ABSTRACT

A reversible mortise lock comprises a latch bolt which is removable from the housing for ease of reversal. A securing member is disposed inside the lock housing for releasbly holding the latch bolt in the housing. The securing member includes a securing element having a blocking surface biased into engagement with the latch bolt for securing the latch bolt to the securing member. The securing element has a surface accessible from outside the lock housing which when pressed releases the latch bolt from the securing member. Once the latch bolt is freed, the latch bolt can be completely removed from the lock housing, reversed and reinstalled. This releasing surface is only accessible through the side walls of the lock housing. Therefore, latch bolt reversal must be performed before the lock is installed in a door. Once the lock is installed, the latch bolt cannot be reversed because the latch bolt cannot be removed from the lock. A locking mechanism for use in the lock comprises a blocking element in the housing and a toggle for manually moving the blocking element between a locked position and an unlocked position relative to a latch operator. A stop is removably attached to the blocking element and adapted in the locked position to prevent operation of the outside latch operator. The stop is also accessible through the side walls of the lock housing and positioning of the stop in the blocking element is accomplished before installation. Preferably, the stop is a threaded plug which is received in a threaded opening in the blocking element. Thus, a screw driver is the only tool needed to release the latch bolt from the lock housing for reversal of the latch bolt and locking mechanism.

22 Claims, 9 Drawing Sheets

U.S. PATENT DOCUMENTS

| | | | | | |
|---|---|---|---|---|---|
| 2,673,758 | A | * | 3/1954 | Schlage | 292/244 |
| 2,823,538 | A | | 2/1958 | Fresard | 70/462 |
| 3,211,486 | A | | 10/1965 | Crandell | 292/348 |
| 3,235,301 | A | | 2/1966 | Russel et al. | 292/244 |
| 3,242,706 | A | | 3/1966 | Check | 70/110 |
| 3,257,136 | A | | 6/1966 | Russel et al. | 292/244 |
| 3,361,462 | A | * | 1/1968 | Foster | 292/165 |
| 3,361,464 | A | | 1/1968 | Foster | 292/245 |
| RE26,677 | E | * | 10/1969 | Russell et al. | 292/34 |
| 3,631,695 | A | | 1/1972 | Velbert et al. | 70/432 |
| 3,672,714 | A | * | 6/1972 | Schultz | 292/34 |
| 3,750,433 | A | | 8/1973 | Sanders | 70/146 |
| 3,769,822 | A | * | 11/1973 | Yulkowski | 70/107 |
| 3,808,849 | A | | 5/1974 | Alexander | 70/149 |
| 4,071,270 | A | | 1/1978 | Alexander | 292/169.22 |
| 4,118,056 | A | | 10/1978 | Alexander | 292/169.17 |
| 4,243,256 | A | | 1/1981 | Frydrych | 292/245 |
| 4,286,812 | A | | 9/1981 | Sprekeler | 292/245 |
| 4,389,061 | A | * | 6/1983 | Foshee | 292/169.14 |
| 4,462,230 | A | | 7/1984 | Evans | 70/383 |
| 4,468,059 | A | | 8/1984 | Nelson et al. | 292/337 |
| 4,470,278 | A | | 9/1984 | Hale et al. | 70/134 |
| 4,470,279 | A | | 9/1984 | Neary et al. | 70/134 |
| 4,583,382 | A | | 4/1986 | Hull | 70/107 |
| 4,674,776 | A | | 6/1987 | James | 292/40 |
| 4,695,082 | A | | 9/1987 | Marks | 292/169.16 |
| 4,696,174 | A | | 9/1987 | Marks | 70/451 |
| 4,798,065 | A | | 1/1989 | DeForrest, Sr. | 70/129 |
| 4,817,404 | A | | 4/1989 | Eisermann et al. | 70/134 |
| 4,950,005 | A | * | 8/1990 | Cudd | 292/150 |
| 4,988,133 | A | | 1/1991 | Shih | 292/191 |
| 5,201,200 | A | | 4/1993 | Hauber | 70/107 |
| 5,259,652 | A | * | 11/1993 | Adams | 292/169.14 |
| 5,308,131 | A | | 5/1994 | Galindo et al. | 292/337 |
| 5,395,144 | A | | 3/1995 | Galindo | 292/169 |
| 5,604,970 | A | | 2/1997 | Aigner et al. | 29/525 |
| 5,676,407 | A | | 10/1997 | Smallegan et al. | 292/139 |
| 5,678,870 | A | | 10/1997 | Pelletier | 292/244 |

* cited by examiner

REVERSIBLE MORTISE LOCK

BACKGROUND

This invention relates generally to mortise locks, and more particularly to latch assemblies and locking mechanisms for use in reversible mortise locks.

A mortise lock is designed to fit into a mortised recess formed in the edge of a door which is opposite to the edge of the door that is hinged to the door frame. The mortise lock generally includes a rectangular housing, or case, which encloses the lock components. The principal lock component is a beveled latch bolt which projects beyond the edge of the door and into an opening in the door frame to latch the door in a closed position. The latch bolt is moveable to a retracted position inside the case to permit opening of the door by operation of a latch operator, such as a door knob or lever handle.

Mortise locks are typically configured so that the latch operators mounted on the inside and outside surfaces of the door can operate independently. The outside latch operator can either be rotated to retract the latch bolt, or locked against rotation to prevent retraction of the latch bolt. Preferably, the inside latch operator can always be rotated to retract the latch bolt. The locking of the outside latch operator is usually controlled by a manual actuator, such as, for example, push buttons or a pivoted toggle, which is exposed at the edge of the mortise lock near the latch. The manual actuator has an associated link within the mortise lock case which, in one position of the manual actuator, engages a moveable portion of the outside latch operator inside the lock case so as to prevent rotation of the latch operator. In a second position, the link disengages from the moveable portion thus permitting rotation of the outside latch operator. The inside latch operator is usually unaffected by the manipulation of the manual actuator and remains rotatable at all times.

Adjustments must be made to the mortise lock depending on whether the lock is mounted in a left-hand or right-hand door. A mortise lock mounted in a left-hand door must be rotated 180° about a vertical axis for mounting in a right-hand door. Consequently, the latch bolt must also be rotated 180° about a horizontal axis so that the beveled face of the latch faces the door-closing direction. In addition, the inside and outside latch operators of the left-hand door mounted lock become the outside and inside latch operators, respectively, of the right-hand door mounted lock. Therefore, a change must be made if the latch operator controlled by the locking mechanism happens to be the inside latch operator when the lock is installed.

The necessary adjustments to the mortise lock can be accomplished without opening the case. Typically, the latch bolt can be pulled partially out of the housing, usually against the force of a spring, rotated 180° and then allowed to be pulled back into the housing by the spring. However, this arrangement can lead to tampering after the lock is installed since the latch bolt can be reversed even when the mortise lock is in the door, which would prevent the door from closing. Moreover, the conventional mechanisms for reversing the operation of the locking mechanism are complicated and difficult to manipulate.

For the foregoing reasons, there is a need for a latch assembly for use in a reversible mortise lock which includes a latch bolt that cannot be reversed after the lock is installed in a door. Reversal of the latch bolt for use with a door of the opposite hand should be easily accomplished in the field. Further, any corresponding changes in the locking mechanism to effect locking of the outside latch operator should also be uncomplicated. The new latch assembly and locking mechanism should be straightforward in manufacture and use.

SUMMARY

Therefore, it is an object of the present invention to provide a reversible mortise lock wherein the latch assembly cannot be reversed when the lock is installed on the door.

A further object of the present invention is to provide a new latch assembly and locking mechanism for a mortise lock which are simple to reverse in the field prior to installation in the door.

According to the present invention, a mortise lock includes a latch assembly comprising a latch bolt having a first portion adapted to project from an opening in the lock housing in an extended position of the latch bolt while a second portion of the latch bolt remains within the lock housing. The latch bolt is removable from the lock housing through the opening. A securing member inside the housing is releasably attached to the second portion of the latch bolt.

The securing member comprises a securing element having a blocking surface and means for biasing the securing element and blocking surface into engagement with the second portion of the latch bolt for releasably securing the latch bolt to the moving member. The securing element further comprises a disengaging surface which when moved against the force of the biasing means releases the second portion of the latch bolt from the securing member so that the latch bolt may be removed from the lock housing.

In further accord with the present invention, a mortise lock of the type having a latch bolt normally projecting from the lock housing and means including a moveable member in the lock housing connected to a door knob or lever handle for moving the latch bolt to a retracted position in the housing, has a locking mechanism comprising a blocking element in the housing and means for moving the blocking element between a locked position and an unlocked position relative the moveable member. The blocking element has an opening adapted to receive a portion of the moveable member when the blocking element is in the locked position for allowing the moveable member to move and the door knob or lever handle to rotate. A stop is removably positioned in the opening of the blocking element for preventing movement of the moveable member when the blocking element is in the locked position.

Also in accord with the present invention, a mortise lock comprises a housing and a latch bolt removably mounted in the housing through an opening in the housing. A securing member is disposed inside the housing for movement relative to the housing. The securing member comprises a securing element having a blocking surface and means for biasing the blocking surface into engagement with the latch bolt for releasably securing the latch bolt to the securing member. The securing element further comprises a surface which when pressed moves the securing element against the force of the biasing means for releasing the latch bolt from the securing member so that the latch bolt may be removed from the housing. The securing member is moveable between a first position where the latch bolt is inside the housing and a second position where a portion of the latch bolt projects through the opening in the housing. Means for moving the securing member to the first position are provided, including a moveable member in the housing. A blocking element is disposed in the housing and means are provided for moving the blocking element between a locked position and an unlocked position relative to the moveable member. A stop is removably attached to the blocking element and adapted in the locked position to prevent operation of the moveable member.

An important feature of the present invention is that the releasing surface of the securing member is only accessible through the side walls of the mortise lock case. Therefore, latch bolt reversal must be performed before the lock is installed. Moreover, once the latch bolt is freed from the moveable member, the latch bolt can be completely removed from the lock housing, reversed and reinstalled. The blocking element and removable stop for locking the lock are also accessible through the side walls of the lock housing. Thus, repositioning of the stop in the blocking element is also accomplished before installation. Preferably, the stop is a threaded plug which is received in a threaded opening in the blocking element.

Reversal of the latch bolt and locking mechanism is simple to perform prior to installation of the lock. A screw driver is the only tool needed to release the latch bolt from the lock housing for reversal of the latch bolt and locking mechanism. Once the lock is installed in a door, the latch bolt cannot be reversed because the latch bolt cannot be removed from the lock.

Additional objects, features and advantages of the present invention will be apparent from the following description in which references are made to the accompanying drawings.

BRIEF DESCRIPTION OF THE DRAWINGS

For a more complete understanding of the present invention, reference should now be had to the embodiments shown in the accompanying drawings and described below.

DESCRIPTION

The latch bolt and locking mechanism according to the present invention are for use in a mortise lock and may be used with any conventional mortise lock assembly such as, for example, the mortise lock assembly described by U.S. Pat. No. 4,118,056, the contents of which are hereby incorporated by reference. Accordingly, detailed explanations of the functioning of all of the mortise lock components are deemed unnecessary for understanding of the present invention by one of ordinary skill in the art.

Figure 1:
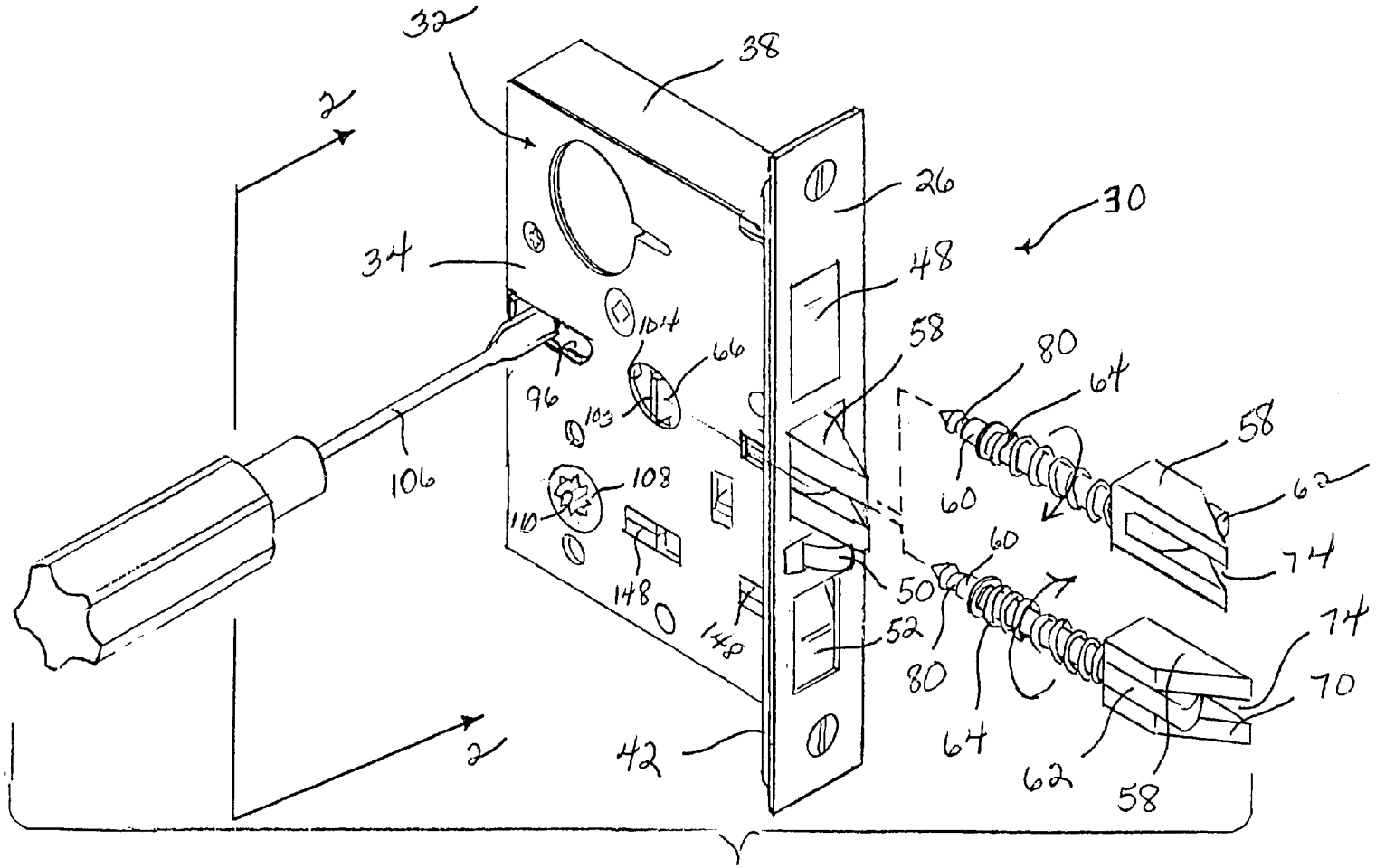
FIG. 1 is a perspective view of an embodiment of a mortise lock assembly according to the present invention.

Referring now to FIG. 1, a mortise lock assembly according to the present invention is shown and is generally designated by reference numeral 30. The lock 30 comprises a generally rectangular box, or case 32, for housing the lock components and is adapted to be received in a mortise in the free, or unhinged, edge of a door. One of the side walls of the case 32 comprises a cap 34 which is secured to and forms a closure for the case 32.

Figure 2:
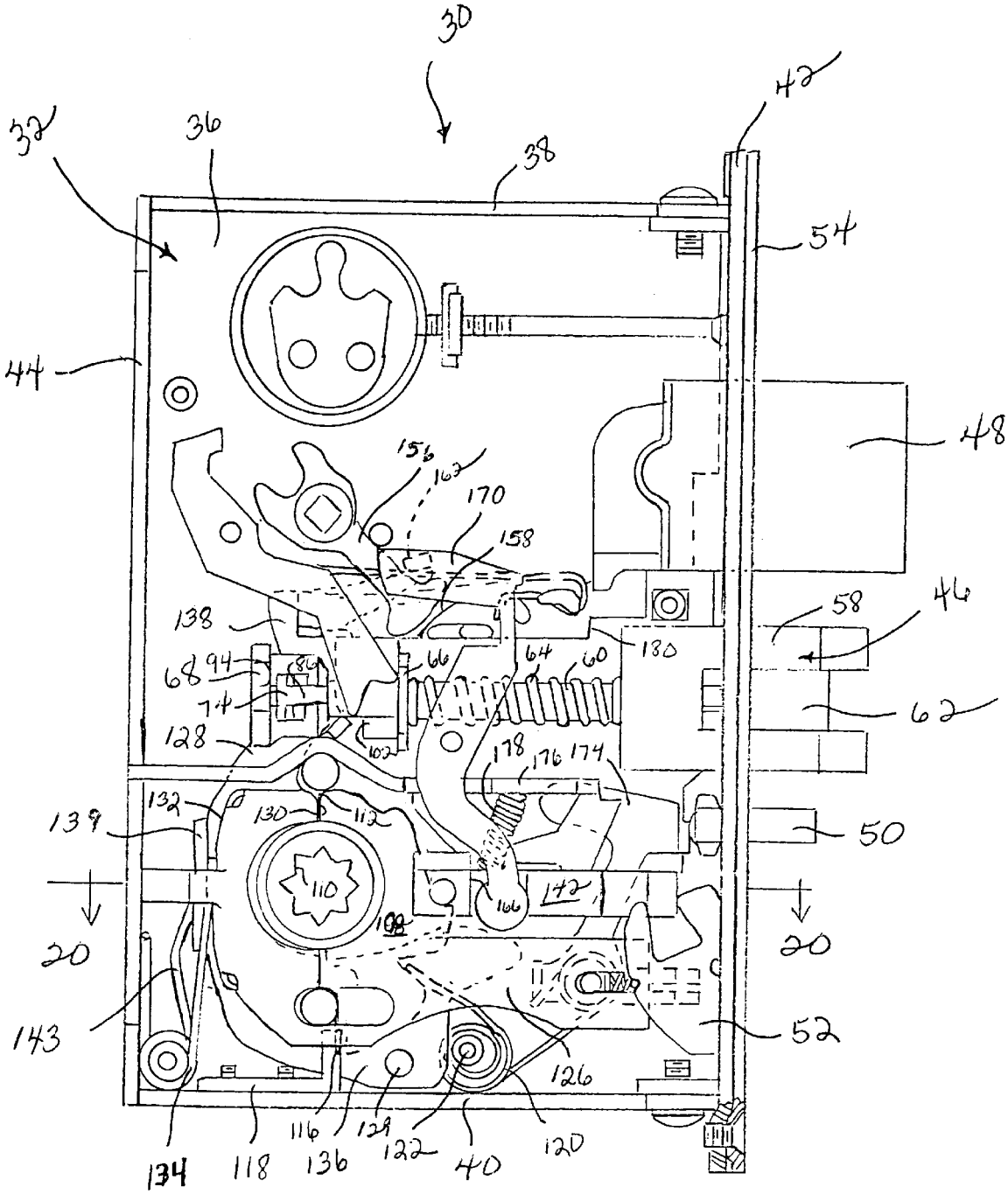
FIG. 2 is a elevation view of the mortise lock assembly taken along line 2—2 of FIG.

FIG. 2 shows the lock with the cap side wall 34 removed. The case 32 includes a side wall 36 and, as seen in FIG. 2, integral top 38, bottom 40, front 42 and rear 44 walls. The front wall 42 has openings for a latch bolt 46, a deadbolt 48, an auxiliary bolt 50 and a flush-mounted toggle 52. A face plate 54 is secured to the front wall of the case 32 and has openings which correspond to the openings in the front wall 42. The latch bolt 46, deadbolt 48 and auxiliary bolt 50 are shown projecting from their respective openings in the front wall 42 and face plate 54.

Figure 3:
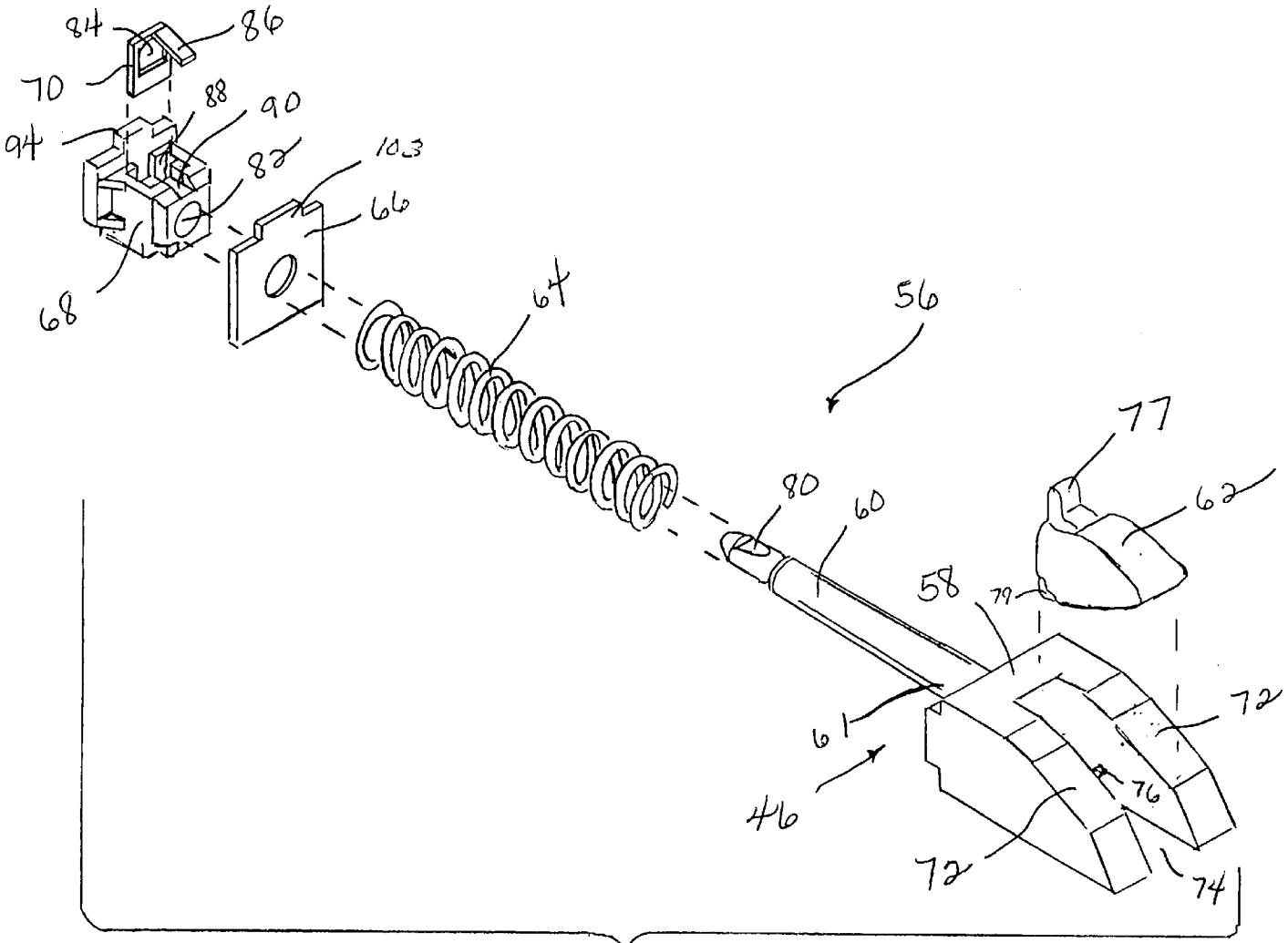
FIG. 3 is a perspective exploded view of an embodiment of a latch assembly used in the mortise lock assembly FIG. 1.
Figure 12:
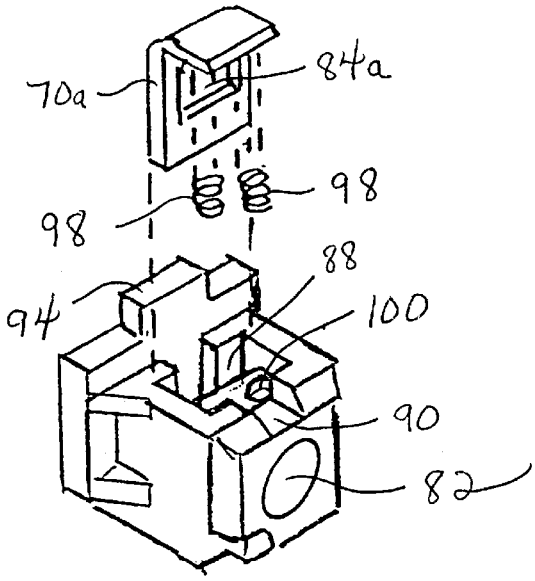
FIG. 12 is an exploded perspective view of an alternative embodiment of a tail plate and spring clip f use in the latch assembly of FIG. 3.

An embodiment of the latch assembly for use in the mortise lock assembly of FIG. 2 is shown in FIG. 3 and designated generally at 56. The latch assembly 56 comprises the latch bolt 46 including a bolt head 58 and an integral latch tail 60, an anti-friction latch 62, a coil spring 64, a spring flange 66, a tail plate 68 and spring clip 70. The bolt head 58 includes a beveled face 72 and a slot 74. A short pin 76 extends from one side of the bolt head 58 and into the slot 74 for pivotally mounting the anti-friction latch 62.

Figure 5:
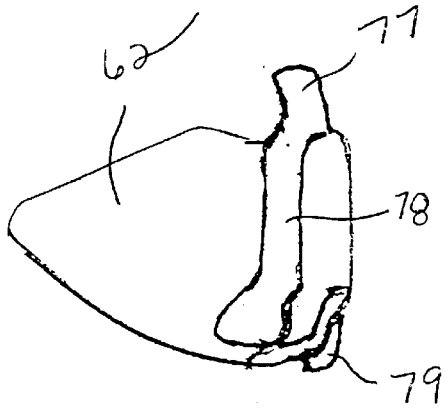
FIGS. 4 and 5 are opposite side elevational views of an anti-friction latch used in the latch assembly of FIGS. 6 and 7 are front and rear elevational views, respectively, of the latch tail and spring clip of FIG 3.
Figure 4:
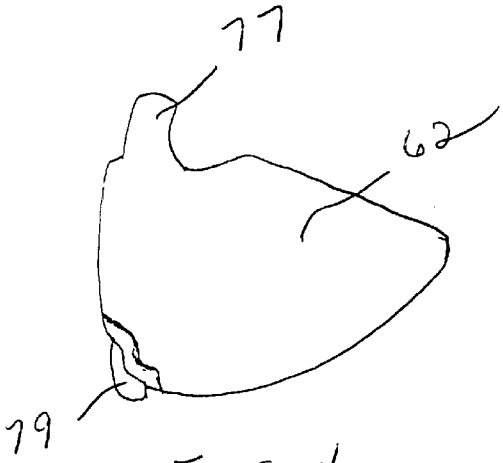

The anti-friction latch 62 is shown in more detail in FIGS. 4 and 5. As seen in FIG. 5, one side of the anti-friction latch 62 has a groove 78 for receiving the pin 76 when the anti-friction latch 62 is slipped into the slot 74 during manufacture. The groove 78 is closed near its open end in a press operation to keep the anti-friction latch 62 in the bolt head 58. A lever 77 extends from one side of the anti-friction latch and a stub 79 extends from the opposite side. When the latch assembly 56 is in the case (FIG. 2), the anti-friction latch 62 and the opening for the latch bolt 46 in the front wall 42 of the case 32 are configured so that the lever 77 engages behind the front wall 42 while the stub 79 engages behind the face plate 54.

Returning to FIG. 3, the latch tail 60 extends from the rear of the bolt head 58. The portion 61 of the latch tail 60 adjacent the bolt head 58 is thicker than the free end so that the coil spring 64 must be forced onto that portion of the latch tail thereby holding the coil spring 64 on the latch tail 60. The free end of the latch tail 60 is rounded and includes a notch 80 longitudinally spaced from the free end. The tail plate 68 is generally cube-shaped and has a pass-through opening 82 for receiving the free end of the latch tail 60. The spring clip 70 is a flat rectangular piece defining an irregular opening 84 and having an angled tab 86 extending from one edge of the clip 84. The tail plate 68 has a slot 88 which intersects the tail plate opening 82 for receiving the spring clip 70. The spring clip tab 86 fits in a groove 90 in the side of the tail plate 68.

Figure 6:
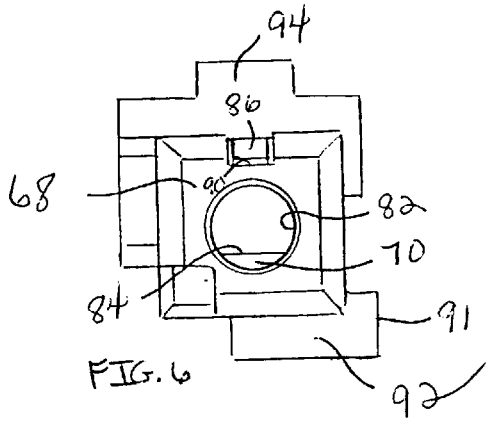
Figure 7:
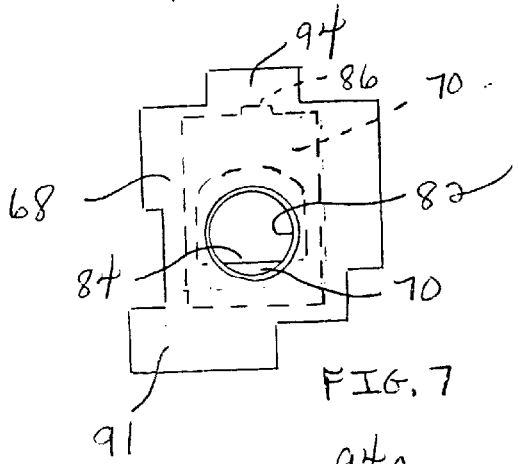
Figure 13:
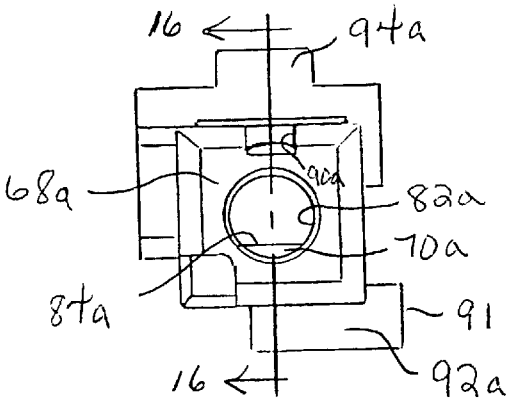
FIGS. 13 and 14 are front and rear elevational views, respectively, of the tail plate and spring clip embodiment of FIG. 12 similar to FIGS. 6 and 7.
Figure 14:
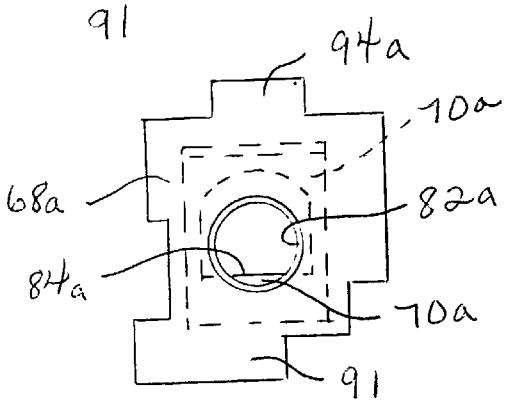
Figure 8:
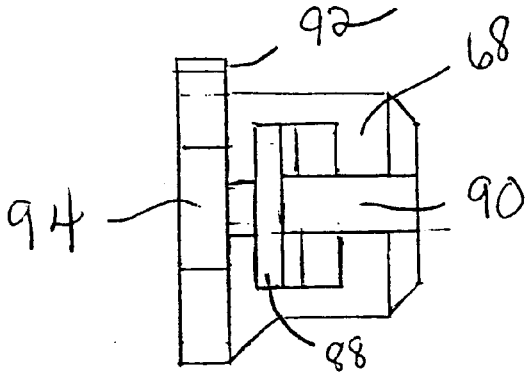
FIGS. 8, 9, 10 and 11 are side elevational views of the tail plate of FIG. 3.

Each side of the tail plate 68 is shown in FIGS. 6 through 11. The tail plate 68 has a support boss 91 which sits against the case side wall 34 when the tail plate 68 is in the case 32. The support boss 91 has a retraction surface 92. An opposed boss 94 fits in a linear guide slot 96 in the cap side wall 14 (FIG. 1) for guiding and supporting linear movement of the tail plate 68. Referring particularly to FIGS. 6 and 7, the tail plate 68 is shown from the front and rear, respectively, with the spring clip 70 in the slot 88 in the tail plate 68. The irregular opening 84 in the spring clip 70 aligns with the opening 82 in the tail plate 68. The dimensions of the spring clip 70 and the position of the slot 88 are such that the spring clip 70 partially blocks the opening 82 through the tail plate 68. The tab 86 is braced against the surface of the groove 90 in the tail plate 68 to bias the spring clip 70 upward to this position as seen in FIGS. 6 and 7.

Figure 10:
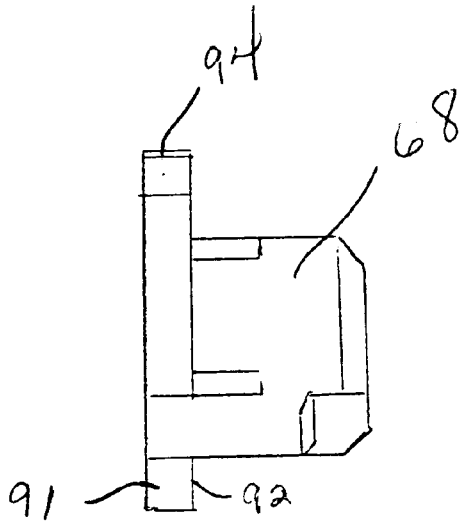
Figure 9:
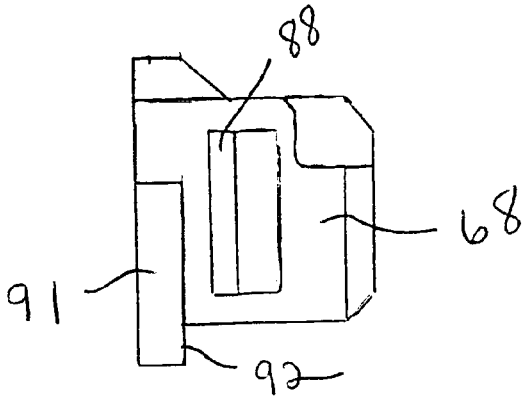
Figure 11:
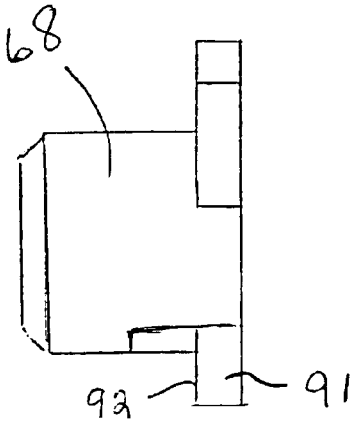
Figure 15:
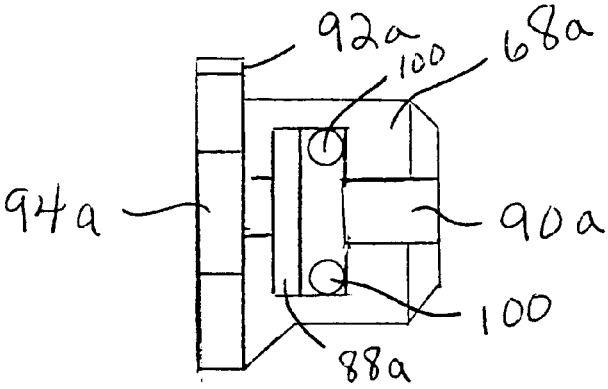
FIG. 15 is a side elevational view of the tail plate embodiment of FIG. 12 similar to FIG. 8.

An alternative embodiment of the tail plate 68*a* and spring clip 70*a* for use in the latch assembly 56 of the present invention is shown in FIGS. 12 through 15. In this embodiment, the spring clip 70*a* is L-shaped and has an irregular opening 84*a*. Two coil springs 98 are disposed in depressions 100 (FIG. 15) in the tail plate surface on either side of the groove 90*a* for biasing the spring clip 70*a* upward to the position shown in FIGS. 13 and 14 partially blocking the opening 82*a* in the tail plate 68*a*. The other sides of the tail plate 68*a* are configured the same as seen in FIGS. 9–11.

Figure 16:
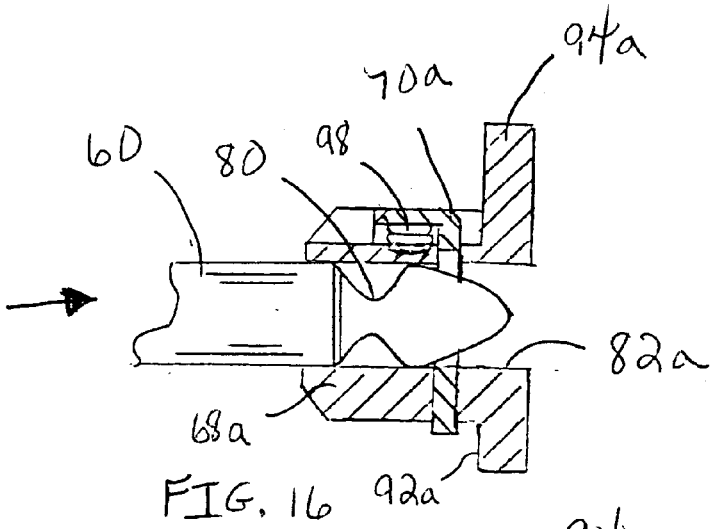
FIGS. 16 and 17 are side sectional views of the tail plate and spring clip embodiment of FIG. 12 showing the latch tail entering the tail plate taken along line 16—16 of FIG. 13.
Figure 17:
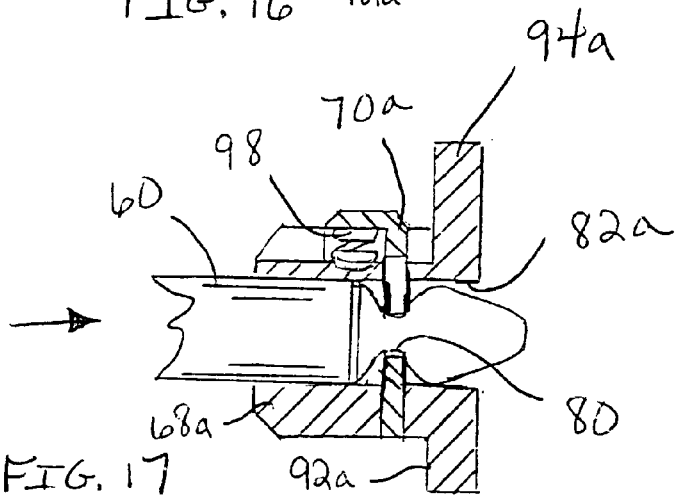

Connection of the latch bolt 46 to the tail plate 68*a* and spring clip 70a is shown in FIGS. 16 and 17. In FIG. 16, the free end of the latch tail 60 is shown entering the opening 82*a* in the tail plate 68*a*. As the latch tail 60 initially enters the tail plate 68*a*, the rounded end engages the edge of the opening 84*a* in the spring clip 70*a* forcing the clip down and compressing the springs 98. When the latch tail notch 80 passes the spring clip 70*a*, the springs 98 push the clip upward so that the edge of the opening 84*a* in the clip engages behind the notch 80 in the latch tail 60 securing the latch tail in the tail plate 68*a*. It is understood that the embodiments of the tail plate and spring clip in FIGS. 6 through 15 are exemplary and other structures are possible, as long as the function of the overall structure for releasably holding the latch tail in the tail plate is maintained.

As seen in FIG. 2, when the latch assembly 56 is in position in the mortise lock assembly 30, a substantial portion of the latch bolt 46 is inside the case 32 even when the latch bolt 46 is in the extended position with a predetermined portion projecting beyond the front of the case 32. The latch tail 60 extends rearwardly from the bolt head 58 through a guide slot formed in a boss 102 fixedly mounted between the side walls 34, 36 for guiding and supporting the linear reciprocal movement of the latch bolt 46. The coil spring 64 is held in compression between the bolt head 58 and the spring flange 66, which is urged against the boss 102, for normally biasing the latch bolt 46 outwardly to the extended position. A boss 103 on the spring flange 66 fits in a hole 104 (FIG. 1) in the cap side wall 34 for holding the flange 66 in position.

The latch bolt 46 is moveable in the openings in the front wall 42 of the case 32 and face plate 54 to the retracted position inside the case by operation of a latch operator comprising either an inside or outside knob or lever handle (not shown). In addition, the latch bolt 46 automatically retracts when the anti-friction latch 62 and the beveled face 70 of the bolt head 58 engage the door frame upon closing of the door. Initially, the anti-friction latch 62 engages the door frame pivoting the anti-friction latch on the pin 76 in the bolt head 58. As the anti-friction latch 62 pivots, the lever 77 works against the front wall 42 of the case 32 driving the latch bolt 46 rearward into the case 32. When the latch operator is released, or the door is in the door 20B frame, the coil spring 64 returns the latch bolt 46 to the extended position.

Figure 18:
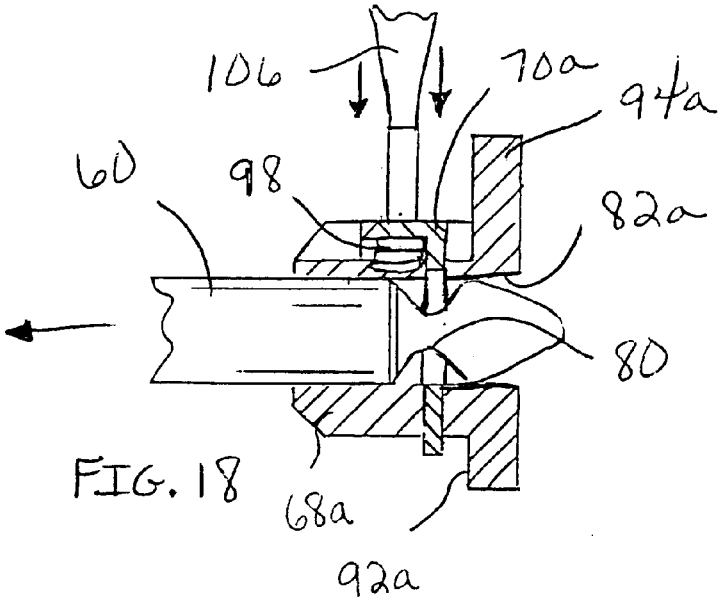
FIG. 18. is a side sectional view of the tail plate and spring clip embodiment of FIGS. 16 and 17 in combination with a screw driver blade illustrating the removal of the latch tail from the tail plate.

According to the present invention, the latch bolt 46 is reversible for use with a door of the opposite hand. In order to reverse the latch bolt 46, it is necessary to disconnect the latch bolt from the tail plate 68 and remove the latch bolt 46 from the lock assembly 10. This is accomplished by first removing the face plate 54 and then manually pushing the latch bolt 46 into the case 32. Next, the user manually depresses the spring clip 70, which is accessible through the guide slot 96 in the cap side wall 34. As seen in FIG. 18, by pressing on the spring clip 70*a* with a screw driver 106 or other tool, the spring clip 70*a* is pushed down against the force of the springs 98 thereby releasing the latch tail 60 from the spring clip 70*a* and tail plate 68*a*. When the latch bolt 46 is free of the tail plate 68*a*, the latch bolt 46 may be pulled through the opening in the front wall 42 of the case 32 (FIG. 1), rotated 180° , inserted into the case 32 and reattached to the tail plate 68*a*, as described above. The slot 96 and hole 104 in the cap side wall 34 are used for viewing to guide the latch tail 60 through the flange 66 and boss 102 and into the opening 82*a* in the tail plate 68*a*. Because the anti-friction latch 62 can pivot and move linearly with respect to the bolt head 58 on the pin 76, at least to the extent of the groove 78 which has not been pressed in, the latch bolt 42 is easily manipulated during removal and reinsertion.

It is understood that other means for biasing the spring clip to the position where the spring clip partially blocks the tail plate opening are possible. For example, the spring clip embodiment shown in FIGS. 12 through 15 would work without the coil springs if the clip material was flexible enough to allow the clip to be pushed down to clear the tail plate opening. Thus, we do not intend ourselves to limit to the specific embodiments of the spring clip biasing means shown herein.

Figure 19:
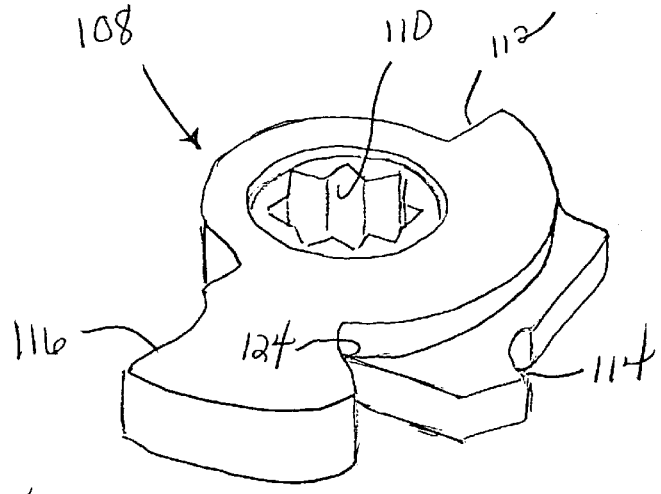
FIG. 19 is a perspective view of a hub used in the mortise lock assembly of FIG. 1.

As noted above, the latch operator comprises means for retracting the latch bolt 46 including an inside or outside knob or lever handle. The retracting means comprises two independent, coaxial rollback hubs 108 which are mirror images of one another. The hubs 108 are rotatably mounted in opposed holes in the walls 34, 36 of the case 32 below the latch assembly 56 (FIG. 2). The hub 108 which fits in the case side wall 36 is shown in FIG. 19. The hubs include a star-shaped aperture 110 for non-rotatable connection to inside and outside spindle drives (not shown) connected to the knobs or lever handles for rotating the hubs 108. Each hub 108 has an upper rollback surface 112 which faces the rear wall 44 of the case 32, a forwardly extending boss 114 and downwardly depending legs 116. As seen in FIG. 2, the legs 116 engage an L-shaped bracket 118 attached to the bottom of the case 32 for preventing clockwise rotation (as seen in FIG. 2) of the hubs 108. Two torsion springs 120 are mounted on a transverse pin 122 adjacent to the front of each hub 108. An end of each spring 120 fits in a notch 124 (FIG.

18) in the hubs 108 for restoring the hubs to the neutral or home position when the knob or handle is released. It is understood that, as an alternative, the mortise lock assembly may have a single hub to which both the inside and outside spindle drives are connected.

Figure 24:
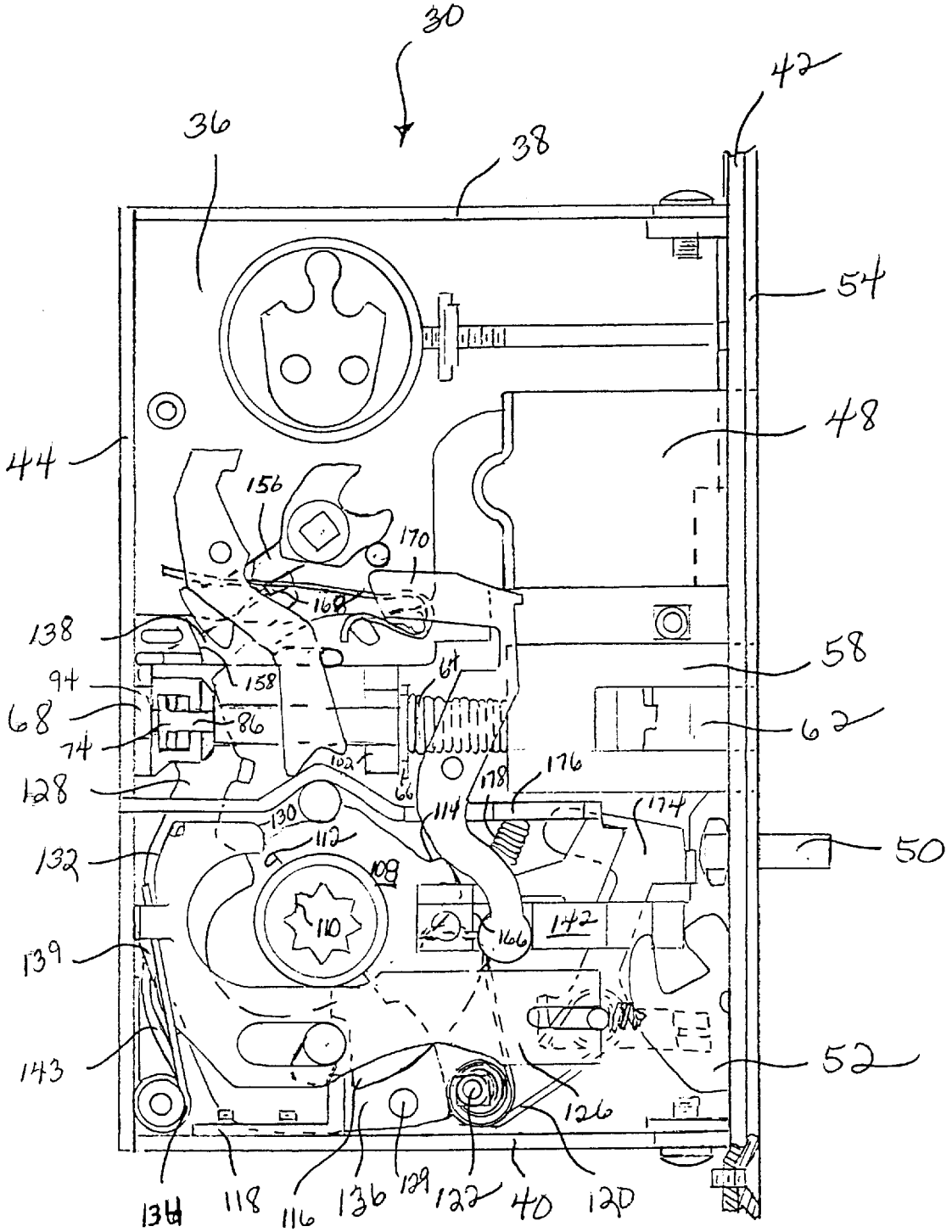
FIG. 24, the same view of the mortise lock assembly of FIG. 2 but showing the latch bolt and deadbolt retracted into the case by actuation of a latch operator.

The retracting means also includes a retractor shoe 126 and a hub lever 128. The shoe 126 is mounted for linear movement within the case 32 and has a forwardly facing bearing surface 130 for engaging the rollback surfaces 112 of the hubs 108 and a rearwardly facing bearing surface 132. In this arrangement, the shoe 126 moves linearly rearward in response to counterclockwise rotation, as seen in FIGS. 2 and 24, of either of the rollback hubs 108. A torsion spring 134 acts between the rear wall 44 and the retractor shoe 126 to urge the shoe toward engagement with the roll back hubs 108.

The hub lever 128 comprises a generally flat, L-shaped lever disposed within the case 32 against the case side wall 36. The hub lever 128 is pivotally supported on a pin 129 at its lower forward leg 136 below and in front of the hubs 108. The upper leg 138 of the hub lever 128 extends upwardly to the rear of the hubs 108 and has a first laterally projecting tab 139 adjacent the rearward bearing surface 132 of the shoe 126. A portion of the upper leg of 138 of the hub lever 128 is adjacent to the retraction surface 92 of the tail plate 68. A torsion spring 143 acts between the rear wall 44 and the first tab 139 to bias the hub lever 128 into operative engagement with the retractor shoe 126.

As seen in FIG. 24, the latch bolt 46 is retracted by rotating one of the rollback hubs 108. Rotation of the rollback hub 108 causes the rollback surface 112 to engage the bearing surface 130 of the retractor shoe 126 moving the shoe linearly rearward. The shoe's rearward bearing surface 132 engages the first hub lever tab 139 to pivot the hub lever 128 in a counterclockwise direction as seen in FIG. 24. The portion of the upper leg of 138 of the hub lever 128 acts against the retraction surface 92 of the tail plate 68 to move the tail plate and connected latch bolt 46 to the retracted position.

Figure 20:
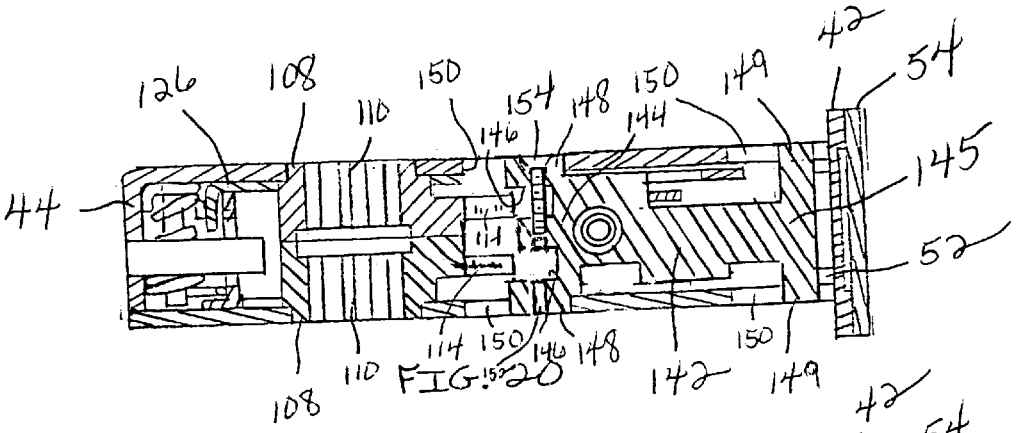
FIG. 20 is a sectional view of the mortise lock assembly of FIG. 2 taken along line 20—20 of FIG. 2 showing an embodiment of a locking mechanism used in the mortise lock assembly of FIG. 1 in an unlocked position.

The present invention is also concerned with the locking mechanism (FIG. 2) for selectively securing one or both of the retractor hubs 108 from rotation. The locking mechanism comprises an elongated slide plate 142 and the toggle 52. Referring to FIG. 20, the rearward end 144 of the slide plate 142 has two slots 146 for receiving a portion of the hubs 108 adjacent the respective bosses 114. Both ends 144, 145 of the slide plate 142 have opposed lateral tabs 148, 149 which ride in corresponding slots 150 in the side walls 34, 36 of the case for guiding and supporting linear movement of the slide plate 142 relative to the hubs 108. Each rear plate tab 148 has a transverse hole 152 which opens into the slots 146. The holes 152 are preferably threaded for receiving a blocking screw 154. The screw 154 is sufficiently long so that when the screw 154 is threaded into the tab 148 the screw extends into the slot 146.

Figure 22:
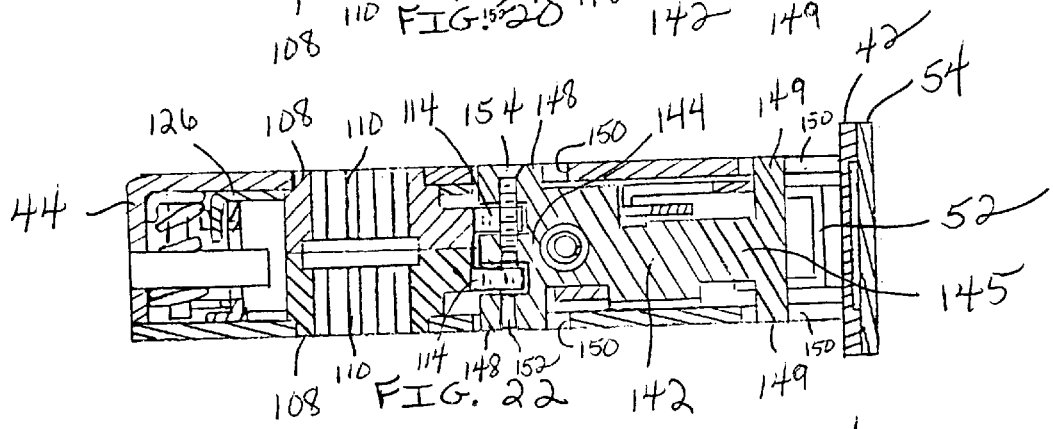
FIGS. 22 and 23 are the same views as FIGS. 20 and 21, respectively, but showing the locking mechanism embodiment in a locked position.
Figure 23:
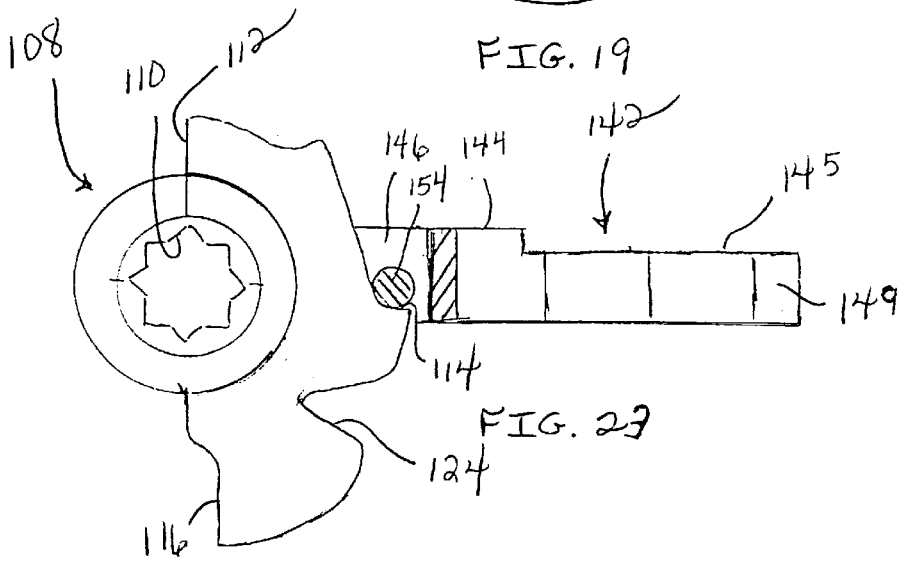
Figure 21:
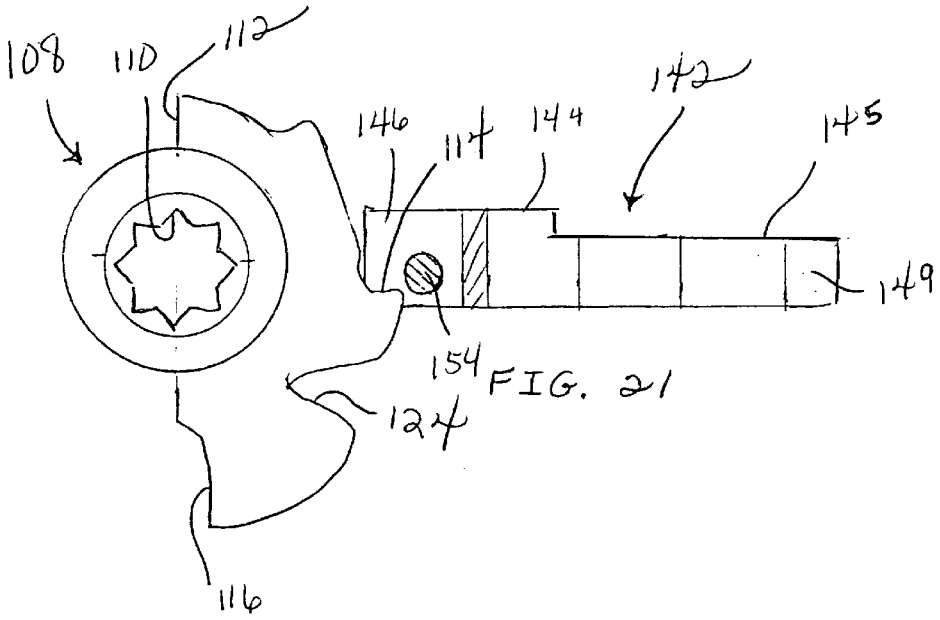
FIG. 21 is side elevational view of the locking mechanism embodiment of FIG. 20 with other lock components removed.

The slide plate 142 is cooperatively linked to the toggle 52 which is accessible through the opening in the front wall 42 and face plate 54. Manipulation of the toggle 52 linearly reciprocates the slide plate 142 relative to the hubs 108 between an unlocked position (FIGS. 20 and 21) and a locked position (FIGS. 22 and 23). The locking mechanism is moved to the locked position by depressing the upper end of the toggle 52 thereby moving the slide plate 142 so that the rearward end 144 is positioned adjacent the hubs 108. When the locking mechanism is in the locked position, the screw 154 is in the path of the boss 114 on one of the retractor hubs 108 thereby preventing rotation of the hub 108. As noted above, the hub 108 preferably affected by the locking mechanism is on the outside of the door. Therefore, the screw 154 is preferably placed in the rear slide plate tab 148 corresponding to the outside hub 108 so as to prevent rotation of the outside hub and retraction of the latch bolt 46 from the outside when the lock is locked. The inside hub 108 can still turn to permit retraction of the latch bolt 46 since the hub boss 114 passes freely through the open slot 146 in the slide plate 142. If the mortise lock is reversed for installation in a door of the opposite hand, the screw 154 is simply moved to the opposite rear tab 148. Of course, in mortise locks using a single hub, the screw prevents rotation of both operators. Similarly, in the illustrated embodiment, a second stop screw can be used with the same effect. The locking mechanism is unlocked by depressing the lower end of the toggle 52 thereby moving the slide toward the front wall 42 of the case 32 and away from the hubs 108 (FIGS. 20 and 21).

Preferably, the mortise lock assembly includes the deadbolt 48 and the auxiliary bolt 50. The deadbolt 48 is selectively moved between an extended position and retracted position by operation of a key cylinder or thumb turn (not shown) in a conventional manner. The cylinder and thumb turn rotate a deadbolt lever 156 which engages the sides of a slot 158 in the rearward end 160 of the deadbolt 48 for extending or retracting the deadbolt. The upper leg 138 of the hub lever 128 has a second laterally projecting tab 162 for engaging the deadbolt lever 156 when the deadbolt 48 is in the extended position for retracting the deadbolt along with the latch bolt 46 in response to rotation of either hub 108 (FIG. 24).

A rotating stop lever 164 is provided for functionally connecting the deadbolt lever 156 and locking mechanism (FIG. 2). The lower end 166 of the stop lever 164 is positioned in a slot 168 in the slide plate 142 and the upper end 170 is arranged in the path of the deadbolt lever 156. When the deadbolt 48 is moved from the retracted position to the extended position the deadbolt lever 156 engages the upper end portion 170 of the stop lever 164 to rotate the lever in a clockwise direction (as seen in FIG. 2) and move the locking mechanism, including the side plate 142 and toggle 52, to the locked position. Thus, the locking mechanism automatically moves to the locked position when the deadbolt 48 is moved to the extended position. The locking mechanism remains in this position, even when the deadbolt 48 is retracted by operation of one of the hubs 108 (FIG. 24), until the toggle 52 is actuated to move the slide plate 142 away-from the hubs 108. When the deadbolt 48 is moved from the retracted position to the extended position the deadbolt lever 156 engages the upper end portion 170 of the stop lever 164 to rotate the lever in a clockwise direction (as seen in FIG. 2) and move the locking mechanism, including the side plate 142 and toggle 52, to the locked position. Thus, the locking mechanism automatically moves to the locked position when the deadbolt 48 is moved to the extended position. The locking mechanism remains in this position, even when the deadbolt 48 is retracted by operation of one of the hubs 108 (FIG. 24), until the toggle 52 is actuated to move the slide plate 142 away from the hubs 108.

Means for deadlocking the latch bolt 46 in the extended position is also provided (FIG. 2). The deadlocking means 172 comprises the auxiliary bolt 50, a deadlocking lever 174 and an auxiliary latch lever 176. When the door is closed, the auxiliary bolt 50 is depressed by the door frame which allows the deadlocking lever 174 to pivot in a counterclockwise direction under the biasing force of a compression spring 178 to a position where the deadlocking lever prevents manual depression of the latch bolt 46. The deadbolt 48 also has a shoulder 180 which is adjacent the rear surface of the bolt head 58 when the deadbolt is extended also for preventing depression of the latch bolt 46.

The previously described embodiments of the present invention have many advantages, including the provision of a reversible mortise lock which cannot be tampered with after installation. Moreover, because the latch bolt reversal relies on removal of the entire latch bolt from the case rather than partial removal, the bolt head can be as long as is practical thereby providing greater strength and security for the lock. The mortise lock incorporating the new latch assembly and locking mechanism is easily modified from outside of the lock casing with a screw driver for use with either a right-hand door or a left-hand door. In either arrangement, the latch operators are operable to open the door when the lock is unlocked. When the lock is locked, rotation of the outside latch operator is prevented, whereas the inside latch operator is still operable to open the door. With the addition of another blocking screw, the inside latch operator can also be locked against rotation.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, a single rollback hub can replace the two, independent hubs so that the locking mechanism affects both the inside and outside latch operators. Accordingly, we intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. A latch assembly for a mortise lock of the type comprising a housing for accommodating the lock components including the latch assembly and having at least one opening, the latch assembly comprising:

a latch bolt adapted to be mounted in the housing so that a first portion of the latch bolt projects from the opening in the housing in an extended position of the latch bolt and a second portion of the latch bolt remains inside the housing in the extended position of the latch bolt;

a securing member adapted to be mounted inside the housing, the securing member comprising a moving member which is adapted to be moveable relative to the housing, a securing element movably mounted to the moving member and comprising a blocking surface, and means for biasing the securing member's blocking surface into engagement with the second portion of the latch bolt for releasably securing together the second portion of the latch bolt and the moving member.

2. A latch assembly as recited in claim 1, wherein the securing element further comprises a disengaging surface which when pressed moves the securing element relative to the moving member against the force of the biasing means for releasing the second portion of the latch bolt from the moving member.

3. A latch assembly for a mortise lock of the type comprising a housing for accommodating the lock components including the latch assembly and having at least one opening, the latch assembly comprising:

a latch bolt adapted to be mounted in the housing so that a first portion of the latch bolt projects from the opening in the housing in an extended position of the latch bolt and a second portion of the latch bolt remains inside the housing in the extended position of the latch bolt, the second portion of the latch bolt comprising a rod; and a securing member adapted to be mounted inside the housing and having an opening for receiving the rod, the securing member comprising a moving member which is adapted to be moveable relative to the housing, a securing element movably mounted to the moving member, the securing element having a blocking surface, and means for biasing the securing element into a blocking position where the blocking surface partially closes the opening in the moving member and into engagement with the surface of the rod for releasably securing the rod in the opening of the moving member.

4. A latch assembly as recited in claim 3, wherein the securing element comprises a substantially flat plate having an opening and the blocking surface comprises an edge of the plate defining the opening, and wherein the moving member has a slot for receiving the plate so that the openings in the plate and moving member are partially aligned when the biasing means biases the plate into the blocking position.

5. A latch assembly as recited in claim 4, wherein the biasing means comprises a resilient tab extending from the edge of the plate and engaging a surface of the moving member when the plate is in the slot.

6. A latch assembly as recited in claim 4, wherein the plate includes a flange extending from the plate, the flange adjacent a surface of the moving member when the plate is in the slot, and the biasing means comprises at least one compression spring disposed between the flange and the surface of the moving member.

7. A latch assembly as recited in claim 4, wherein the securing element has a surface which, when pressed, moves the securing element against the force of the biasing means to a releasing position where the blocking surface is out of the opening in the moving member for freeing the rod from the moving member.

8. A mortise lock, the lock comprising:

a housing having an opening;

a latch bolt removably mounted in the housing and having a first portion and a second portions the second portion of the latch bolt comprising a rod;

a securing member disposed inside the housing for movement relative to the housing between a first position and a second position, the securing member having an opening for receiving the rod for releasably attaching the latch bolt to the securing member so that in the first position of the securing member the latch bolt is inside the housing and in the second position of the securing member the first portion of the latch bolt projects through the opening in the housing and the second portion of the latch bolt remains within the housing, a securing element movably mounted to the securing member, the securing member having a blocking surface;

means for biasing the securing element into a blocking position where the blocking surface partially closes the opening in the securing member and into engagement with the rod for releasably securing the latch bolt in the securing member; and means for moving the securing member to the first position.

9. A latch assembly as recited in claim 8, wherein the securing element comprises a substantially flat plate having an opening and the blocking surface comprises an edge of the plate defining the opening, and wherein the securing member has a slot for receiving the plate so that the openings in the plate and securing member are partially aligned when the biasing means biases the plate into the blocking position.

10. A latch assembly as recited in claim 8, wherein the securing element further comprises a first surface which when pressed moves the securing element against the force of the biasing means to a releasing position where the blocking surface is out of the opening in the securing member for removing the latch bolt from the securing member and out of the housing.

11. A latch assembly as recited in claim 10, wherein the first surface is accessible from outside of the lock housing.

12. A locking mechanism and mortise lock of the type comprising a housing including two principal side walls and edge walls extending between and interconnecting the side walls, one of the side walls removably attached to the remainder of the housing for selectively exposing the interior of the housing, one of the side walls and one of the edge walls of the housing having at least one opening, the housing accommodating the lock components including the locking mechanism, a latch bolt mounted in the housing for movement with respect to the housing from a first position where a portion of the latch bolt extends through the opening in the edge wall of the housing to a second position where the latch bolt is inside the housing, and means for retracting the latch bolt to the second position, the retracting means comprising at least one moveable member connected for movement with a door knob or lever handle, the locking mechanism comprising:

a blocking element adapted to be mounted in the housing for movement between a first position and a second position;

means for moving the blocking element between the first position and the second position; and a stop removably attached to the blocking element and adapted in the second position of the blocking element to prevent movement of the moveable member, wherein the stop is adapted to be selectively detached from or attached to the blocking element through the opening in the side wall of the housing when the removable side wall is attached to the remainder of the housing.

13. A locking mechanism for a mortise lock of the type comprising a housing for accommodating the lock components including the locking mechanism, a latch bolt, and means for retracting the latch bolt comprising at least one moveable member connected for movement with a door knob or lever handle, the locking mechanism comprising:

a blocking element adapted to be mounted in the housing for movement between a first position and a second position, the blocking element having an opening adapted to receive a portion of the moveable member in the second position of the blocking element for allowing the moveable member to moves;

means for moving the blocking element between the first position and the second position; and a stop removably positioned in the opening in the blocking element and adapted in the second position of the blocking element to prevent movement of the moveable member.

14. A locking mechanism and a mortise lock of the type comprising a housing including two principal side walls and edge walls extending between and interconnecting the side walls, one of the side walls being removably attached to the remainder of the housing for selectively exposing the interior of the housing, each of the side walls and one of the edge walls of the housing having at least one opening, the housing accommodating the lock components including the locking mechanism, a latch bolt mounted in the housing for movement with respect to the housing from a first position where a portion of the latch bolt extends through the opening in the edge wall of the housing to a second position where the latch bolt is inside the housing, and means for retracting the latch bolt to the second position, the retracting means comprising two independent moveable members connected for movement with respective door knobs or lever handles, the locking mechanism comprising:

a blocking element adapted to be mounted in the housing for movement between a first position and a second position;

means for moving the blocking element between the first position and the second position; and a stop removably attached to the blocking element and adapted in the second position of the blocking element to prevent movement of one of the moveable members, wherein the stop is adapted to be selectively detached from or attached to the blocking element through the opening in one of the side walls of the housing.

15. A locking mechanism as recited in claim 14, further comprising a second stop removably attached to the blocking element and adapted in the second position of the blocking element to prevent movement of the second moveable member, wherein the stop is adapted to be selectively detached from or attached to the blocking element through the opening in the other side wall of the housing when the removable side wall is attached to the remainder of the housing.

16. A mortise lock, the lock comprising:

a housing including two principal side walls and edge walls extending between and interconnecting the side walls, one of the side walls removably attached to the remainder of the housing for selectively exposing the interior of the housing, each of the side walls and one of the edge walls having at least one opening;

a latch bolt mounted in the housing for movement with respect to the housing from a first position where a portion of the latch bolt extends through the opening in edge wall of the housing to a second position where the latch bolt is inside the housing;

means for moving the latch bolt to the second position, the moving means including a moveable member in the housing;

a blocking element movably mounted in the housing;

means for moving the blocking element between a first position and second position; and a stop removably attached to the blocking element and adapted in the second position of the blocking element to prevent movement of the moveable member, wherein the stop is adapted to be selectively detached from or attached to the blocking element through either of the openings in the side walls of the housing when the removable side wall is attached to the remainder of the housing.

17. A mortise lock, the lock comprising:

a housing having an opening;

a latch bolt mounted in the housing for movement with respect to the housing from a first position where a portion of the latch bolt extends outside the housing to a second position where the latch bolt is inside the housing;

means for moving the latch bolt to the second position, the moving means including a moveable member in the housing;

a blocking element movably mounted in the housing, the blocking element having an opening adapted to receive a portion of the movable member in the second position of the blocking element for allowing the movable member to move;

means for moving the blocking element between a first position and second position;

a stop removably positioned in the opening in the blocking element and adapted in the second position of the blocking element to prevent movement of the moveable member.

18. A locking mechanism for a mortise lock as recited in claim 17, wherein the moveable member is a rotating hub having a blocking surface which is engaged by the in the second position of the blocking element to prevent rotation of the hub.

19. A mortise lock, the lock comprising:

a housing including two principal side walls and edge walls extending between and interconnecting the side walls, one of the side walls removably attached to the remainder of the housing for selectively exposing the interior of the housing, each of the side walls and one of the edge walls having at least one opening;

a latch bolt removably mounted in the housing;

a securing member disposed inside the housing for movement relative to the housing between a first position and a second position, the securing member releasably attached to the latch bolt so that in the first position of the securing member the latch bolt is inside the housing and in the second position of the securing member a first portion of the latch bolt projects through the opening in the edge wall of the housing and a second portion of the latch bolt remains within the housing;

means for moving the securing member to the first position, the moving means including a moveable member in the housing;

a blocking element movably mounted in the housing;

means for moving the blocking element between a first position and a second position; and a stop removably attached to the blocking element and adapted in the locked position of the blocking element to prevent movement of the moveable member, wherein the stop is adapted to be selectively detached from or attached to the blocking element through either of the openings in the side walls of in the housing when the removable side wall is attached to the reminder of the housing.

20. A mortise, lock the lock comprising:

a housing having an opening;

a latch bolt removably mounted in the housing;

a securing member disposed inside the housing for movement relative to the housing between a first position and a second position the securing member releasably attached to the latch bolt so that in the first portion of the securing member the latch bolt is inside the housing and in the second position of the securing member a first portion of the latch bolt projects through the opening in the housing and a second portion of the latch bolt remains within the housing;

means for moving the securing member to the first position the moving means including a moveable member in the housing;

a blocking element movably in the housing, the blocking element having an opening adapted to receive a portion of the moveable member in the second position of the blocking element for allowing the moveable member to move;

means for moving the blocking element between a first position and a second position, a stop removably positioned in the opening in the blocking element and adapted in the second position of the blocking element to prevent movement of the moveable member.

21. A mortise lock, the lock comprising:

a housing having an opening;

a latch bolt removably mounted in the housing, the latch bolt having a first portion and a second portion, the second portion of the latch bolt comprising a rod;

a securing member disposed inside the housing for movement relative to the housing between a first position and a second position, the securing member having an opening for receiving the rod for releasably attaching the latch bolt to the securing member so that in the first position of the securing member the latch bolt is inside the housing and in the second position of the securing member the first portion of the latch bolt projects through the opening in the housing and the second portion of the latch bolt remains within the housing;

a securing element movably mounted to the securing member, the securing element having a blocking surface; and means for biasing the securing element into a blocking position where the blocking surface partially closes the opening in the securing member and into engagement with the rod for releasably securing the latch bolt in the securing member;

means for moving the securing member to the first position, the moving means including a moveable member in the housing;

a blocking element movably mounted in the housing;

means for moving the blocking element between a first position and a second position; and a stop removably attached to the blocking element and adapted in the locked position of the blocking element to prevent movement of the moveable member.

22. A latch assembly as recited in claim 21, wherein the securing element has a first surface accessible from outside of the lock housing, which first surface when pressed moves the securing element against the force of the biasing means to a releasing position where the blocking surface is out of the opening in the securing member for removing the latch bolt from the securing member and out of the housing.

* * * * *